US007588650B2

(12) United States Patent
Baba et al.

(10) Patent No.: US 7,588,650 B2
(45) Date of Patent: Sep. 15, 2009

(54) HIGH-TEMPERATURE MEMBER FOR USE IN GAS TURBINE

(75) Inventors: Noboru Baba, Hitachiohta (JP); Kazuya Nishi, Hitachiohta (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/082,836

(22) Filed: Mar. 18, 2005

(65) Prior Publication Data

US 2005/0238525 A1 Oct. 27, 2005

Related U.S. Application Data

(63) Continuation of application No. 10/368,483, filed on Feb. 20, 2003, now abandoned.

(30) Foreign Application Priority Data

Feb. 21, 2002 (JP) ..... 2002-44095
Feb. 6, 2003 (JP) ..... 2003-28986

(51) Int. Cl.
*C22C 19/07* (2006.01)

(52) U.S. Cl. ..... 148/425; 148/674; 420/439; 420/436

(58) Field of Classification Search ..... None

See application file for complete search history.

(56) References Cited

U.S. PATENT DOCUMENTS 2,977,224 A * 3/1961 Faulkner ..... 420/436

(Continued)

FOREIGN PATENT DOCUMENTS

DE 33 12 505 C2 10/1983

(Continued)

OTHER PUBLICATIONS

Wahll M.J. et al., Handbook of International Alloy compositions and designations, vol. II, Superalloys, Battelle, Ohio, USA, pp. 116-117.

(Continued)

*Primary Examiner*—John P. Sheehan
(74) *Attorney, Agent, or Firm*—Dickstein Shapiro LLP

(57) ABSTRACT

A high-temperature member for use in a gas turbine, the member being formed from a new wear-resistant alloy having good wear resistance as well as good ductility, is disclosed. The member was developed to prevent wear and damage that occur due to vibration while the turbine is running. The high-temperature member for use in a gas turbine is formed from a new cobalt-based wear-resistant alloy which is composed of a cobalt-chromium matrix and refractory metals, with the content of hard particles (such as carbide) reduced. The refractory metals promote work hardening, thereby improving wear resistance. The reduced content of hard particles contributes to good ductility.

5 Claims, 4 Drawing Sheets

U.S. PATENT DOCUMENTS

| | | | | |
|---|---|---|---|---|
| 3,356,542 | A | 12/1967 | Smith | |
| 3,713,175 | A | 1/1973 | Weisman | |
| 3,865,585 | A | 2/1975 | Rademacher | |
| 4,437,913 | A | 3/1984 | Fukui et al. | |
| 4,830,824 | A | 5/1989 | Lindigkeit | |
| 4,980,241 | A | 12/1990 | Hoffmueller et al. | |
| 5,964,091 | A | 10/1999 | Fukui et al. | |
| 6,315,298 | B1 | 11/2001 | Kildea et al. | |
| 2002/0064678 | A1* | 5/2002 | Kiyotoki et al. | 428/678 |

FOREIGN PATENT DOCUMENTS

| | | | |
|---|---|---|---|
| EP | 0 851 097 | A2 | 7/1998 |
| FR | 2750867 | | 1/1998 |
| GB | 2000188 | | 6/1977 |
| GB | 2 302 551 | A | 1/1997 |
| JP | 55-82740 | | 6/1980 |
| JP | 56-156736 | | 12/1981 |
| JP | 60-17043 | | 1/1985 |
| WO | WO 00/04309 | A1 | 1/2000 |

OTHER PUBLICATIONS

Salinas-Rodriguez A., "The Role of the FCC-HCP Phase Transformation during the Plastic Deformation of Co-Cr-Mo-C Alloys for Biomedical Applications," In Disegi J.A., et al., Eds., "Cobalt-base Alloys for Biomedical Applications" 1999, ASTM, USA, pp. 108-121.

Disegi J.A. et al, EDS: "Co-base alloys for biomedical applications", 1999, ASTM, USA, XP 0022398756, pp. 108-121.

J.R. Davis—ASM Specialty Handbook—Nickel, Cobalt and Their Alloys, pp. 362-370.

* cited by examiner

SAMPLE: ALLOY No.1 ACCORDING TO THE PRESENT INVENTION FOR THE MOBILE SPECIMEN. MEASURED UNDER A LOAD OF 10g FOR 30s AT ROOM TEMPERATURE.

HIGH-TEMPERATURE MEMBER FOR USE IN GAS TURBINE

CROSS REFERENCE TO RELATED APPLICATIONS

The present application is a continuation of U.S. application Ser. No. 10/368,483, filed on Feb. 20, 2003, now abandoned, the disclosure of which is herewith incorporated by reference in its entirety.

BACKGROUND OF THE INVENTION

The present invention relates to a high-temperature member for use in a gas turbine. More particularly, the present invention relates to a high-temperature member formed from a cobalt-based alloy which is less subject to wear and damage due to vibrations generated by a running turbine.

A gas turbine generates, during its operation, continuous vibrations resulting from high-speed revolution of rotors and flows of combustion gas and compressed cooling air. This vibrational action causes wear and damage to high-temperature members constituting the gas turbine. Such wear and damage occur at the part with which each member is in contact by fitting. Since these gas turbine members are used at high temperatures, it is impracticable to supply their sliding parts with a lubricant (such as oil). In many cases they are used without lubrication. Under these circumstances, it is essential to make those members subject to vigorous vibrations from a wear resistant material. Existing high-temperature wear resistant materials are mostly composed of a cobalt—, iron—, or nickel-based alloy and hard particles of carbide or boride in a comparatively high ratio (say, several percent by volume or more).

The above-mentioned high-temperature wear resistant materials are poor in ductility because they contain a large number of hard particles. Consequently, they are hardly formed into a complex shape by machining or a sheet by rolling or pressing at room temperature. This means that they have limitations in the shape of members into which they are made or the manufacturing process by which they are made into members. On the other hand, it is common practice to coat the surface of members (by plasma spraying) with a wear resistant material containing hard particles. However, difficulties are often encountered in forming a perfect coating film on the inside of a member having an intricate shape. Cobalt-based wear resistant alloys (typified by stellite), which are commonly used for surface coating by overlaying or thermal spraying, also encounter difficulties in application to a complicated surface.

Cobalt-based alloys containing a less amount of hard carbide can be made into members in complex shape by cold working; however, such alloys are inevitably incomplete in wear resistance.

SUMMARY OF THE INVENTION

The present inventors thoroughly studied the characteristic properties of the cobalt-based alloy as a wear resistant material. As a result, they found that the wear resistance depends on the characteristics of the cobalt alloy matrix as well as the precipitation of carbides. The cobalt-based alloy has the property that upon wearing at high temperatures, it suffers serious work hardening in its deformed sliding surface. This work hardening forms a hard layer under the sliding surface, and this hard layer prevents further deformation and further abrasion. The cause of work hardening lies in phase transformation from hexagonal structure (low-temperature phase at 421° C. characteristic of pure cobalt) to face-centered cubic structure (high-temperature phase). Therefore, improvement in wear resistance by work hardening is not expected from iron-based alloys or nickel-based alloys which do not undergo phase transformation.

In addition, other elements added to the cobalt-based alloy greatly affect the work hardening characteristics. For example, incorporation with chromium, molybdenum, niobium, tungsten, tantalum, rhenium, silicon, germanium, etc. enhances the work hardening characteristics. (These elements are collectively referred to as "Group 1" hereinafter.) On the other hand, incorporation with nickel, manganese, iron, carbon, etc. weakens the work hardening characteristics. (These elements are collectively referred to as "Group 2" hereinafter.) Therefore, it is possible to promote the work hardening characteristics of the cobalt-based alloy and to improve the wear resistance of the cobalt-based ally if the amount of group 1 elements is increased and the amount of group 2 elements is decreased. Noting that incorporation with carbon does not contribute to improvement in work hardening characteristics, the present inventors found that it is also possible to improve the work hardening characteristics or to impart good wear resistance if the cobalt-based alloy is incorporated with a less amount of carbon so that the formation of carbide particles is suppressed. Moreover, the present inventors found that the amount of nickel also greatly affects the wear resistance of the cobalt-based alloy at high temperatures.

This new wear-resistant cobalt-based alloy excels in ductility because it merely contains a very small amount of carbide formed therein. Thus, it can be formed into a sheet or an intricate shape by rolling or pressing at room temperature.

It is an object of the present invention to provide a high-temperature member for use in a gas turbine, the member being formed from a cobalt-based alloy which has excellent wear resistance as well as good formability that permits working into a sheet or an intricate shape. The high-temperature member is exempt from wear and damage during turbine operation and has a long life which contributes to reduced maintenance cost and improved operating efficiency.

BRIEF DESCRIPTION OF THE DRAWINGS

Other objects and advantages of the invention will become apparent from the following description of embodiments with reference to the accompanying drawings in which.

DESCRIPTION OF THE PREFERRED EMBODIMENTS

Figure 1A:
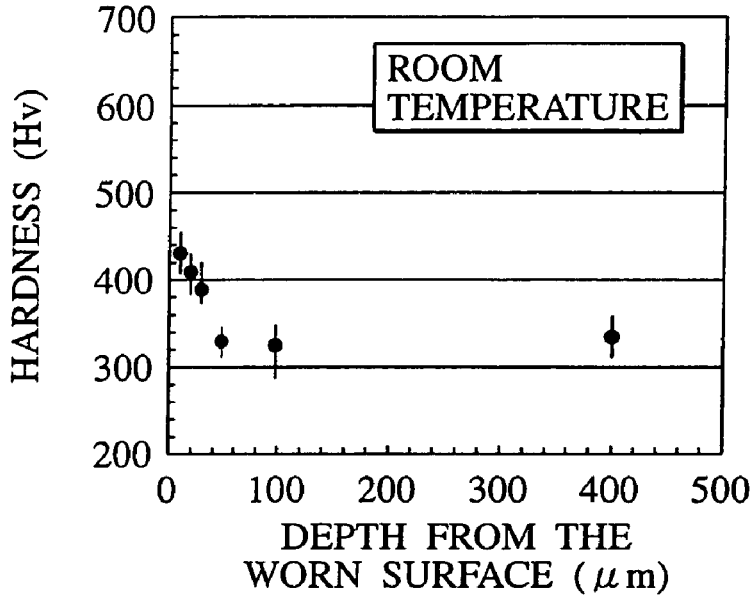
FIGS. 1A and 1B are graphs showing how the alloy of the present invention changes in hardness in the sectional structure after wear resistance test.

Despite the fact that pure cobalt undergoes phase transformation from hexagonal structure (low-temperature phase at 421° C.) to face-centered cubic structure (high-temperature phase), the matrix of most cobalt-based alloys in practical use takes on the face-centered cubic structure at room temperature because alloying prevents phase transformation into the hexagonal structure.

Although metal under force is generally subject to slip deformation due to dislocation of lattice defects, metal of face-centered cubic structure experiences wider dislocation and hence narrower cross slip, which leads to work hardening. It is generally known that the ease with which dislocation extends is defined by a physical constant called stacking fault energy (SFE). When dislocation in face-centered metal expands, the resulting part has an atomic arrangement identical to that of hexagonal structure; therefore, the property that a cobalt-based alloy easily changes into hexagonal structure at low temperatures facilitates expansion of dislocations and decreases cross slip, thereby promoting work hardening. In other words, because of this ease of work hardening, the cobalt-based alloy according to the present invention exhibits outstanding wear resistance.

A mention is made below of the effects of the elements added to the alloy. Incidentally, the amount of elements added is expressed in terms of per cent by weight, unless otherwise stated.

The eight elements exemplified in group 1 above dissolve in the matrix, thereby increasing the high-temperature strength, lowering the alloy's SFE, promoting work hardening, and improving wear resistance.

Chromium improves wear resistance due to work hardening and forms a stable chromium oxide protective film on the alloy surface in an atmosphere at high temperatures, the protective film contributing to oxidation resistance. For chromium to produce this effect, it is necessary that the amount of chromium should be at least 15%. However, an excess amount more than 35% is not desirable because it causes a harmful phase to separate out, making the alloy brittle. An adequate amount of chromium should be in the range of 18-30%.

Molybdenum, niobium, tungsten, tantalum, and rhenium (as refractory metals) promote work hardening, improve wear resistance, and increase high-temperature strength through solid solution strengthening. These five kinds of metals may be used alone or in combination with one another. If more than one of these metals is added, the total amount of metals added should not exceed 10% of the total amount of the ally (excluding carbon). Otherwise, excess metals will form harmful compounds, making the alloy brittle.

Molybdenum alone will not produce the desired effect if added in an amount of 1% or less, or will form a harmful phase (which causes embrittlement) if added in an amount more than 12%. A desirable amount of molybdenum ranges from 3% to 10%. Also, if molybdenum is added together with other four refractory metals, its desirable amount is not less than 0.5%.

Niobium is less soluble than molybdenum in the cobalt matrix. Niobium alone will not produce the desired effect if added in an amount of 0.5% or less, or will form a harmful phase (which causes embrittlement) if added in an amount more than 8%. A desirable amount of niobium ranges from 1% to 6%. Also, if niobium is added together with other four refractory metals, its desirable amount is not less than 0.3%.

Tungsten alone will not produce the desired effect if added in an amount of 2% or less, or will form a harmful phase (which causes embrittlement) if added in an amount more than 20%. A desirable amount of tungsten ranges from 3% to 18%. Also, if tungsten is added together with other four refractory metals, its desirable amount is not less than 1%.

Like niobium, tantalum is less soluble in the cobalt matrix. Tantalum alone will not produce the desired effect if added in an amount of 1% or less, or will form a harmful phase (which causes embrittlement) if added in an amount more than 10%. A desirable amount of tantalum ranges from 2% to 8%. Also, if tantalum is added together with other four refractory metals, its desirable amount is not less than 1%.

Rhenium alone will not produce the desired effect if added in an amount of 0.3% or less, or will increase material cost if added in an amount more than 10%. A desirable amount of rhenium ranges from 0.5 to 7%. Also, if rhenium is added together with other four refractory metals, its desirable amount is not less than 0.5%.

Silicon reduces SFE, contributes to work hardening, and lowers the melting point of the resulting material, thereby improving productivity. Silicon of 0.02% or less does not produce the desired effect, and silicon more than 1.5% deteriorates the ductility of the resulting material. The desirable amount of silicon ranges from 0.04 to 1.2%.

Like silicon, germanium contributes to productivity through improvement in work hardening and reduction in melting point. Germanium not more than 0.1% does not produce the desired effect, and germanium more than 4% deteriorates the strength of the alloy. The desirable amount of germanium ranges from 0.2 to 2.5%.

While enhancing the ductility of the alloy, nickel, manganese and iron increase SFE, thereby suppressing work hardening and decreasing alloy's wear resistance. These three metals added in a total amount of 9% or more greatly deteriorate the high-temperature wear resistance of the alloy. Such an excess amount should be avoided. On the other hand, these three metals added in a total amount of 1% or less greatly deteriorate the ductility of the alloy. Preferably, the three metals added in a total amount ranges from 1 to 7%.

Nickel improves ductility as well as high-temperature strength. Nickel not more than 0.2% does not produce the desired effect, and nickel more than 5% deteriorates the wear resistance of the alloy. The desirable amount of nickel ranges from 0.5 to 4%.

Manganese and iron improve the ductility of the alloy. They will not produce the desired effect if each added in an amount of 0.2% or less. They will greatly deteriorate the wear resistance of the alloy if added in an amount more than 5%. The desirable amounts of manganese and iron each ranges from 0.5 to 4%.

Carbon increases SFE, thereby decreasing work hardening. Nevertheless, a trace amount of carbon is necessary to strengthen grain boundaries and improve ductility. An amount not more than 0.01% is not enough to produce the effect of strengthening grain boundaries; an amount in excess of 0.2% gives rise to carbides which lower ductility and deteriorate work hardening characteristics. A desirable amount of carbon ranges from 0.05 to 0.15%.

A mention is made below of the process for producing the cobalt-based alloy and high-temperature member for use in a gas turbine according to the present invention. The process starts with preparation of an ingot (by vacuum arc melting) from a cobalt-based alloy with a specified composition. The ingot undergoes forging at 1150-1230° C. and then solution treatment for homogenization. Solution treatment may be followed by pressing or rolling (at room temperature or high temperatures) to adjust the shape. The cobalt-based alloy of the present invention does not need any special control for the shape and distribution of carbides or the fine structure such as crystal grain diameter, because it exhibits wear resistance as its matrix undergoes work hardening. Therefore, the above-mentioned process does not need any additional steps such as aging treatment to adjust the shape of carbides and the crystal grain diameter. This leads to an advantage of reducing the number of steps.

EXAMPLE 1

The present invention will be described in more detail with reference to the following examples.

Table 1 shows the chemical composition of the cobalt-based alloys according to the present invention. Samples Nos. 1 to 7 comply with the requirements of the present invention, and the other three samples are for comparison.

TABLE 1

Chemical Composition of Cobalt-based Alloys (unit: wt %)

| Sample | Co | Cr | Mo | Nb | W | Ta | Re | Ge | Ni | Mn | Fe | Si | C |
|---|---|---|---|---|---|---|---|---|---|---|---|---|---|
| No. 1 | Bal. | 19.65 | 8.72 | — | — | — | — | — | 2.43 | 0.45 | 1.12 | 0.44 | 0.11 |
| No. 2 | Bal. | 19.88 | 5.33 | 4.2 | — | — | — | — | 2.66 | 0.49 | 1.02 | 0.56 | 0.1 |
| No. 3 | Bal. | 19.47 | — | — | 15.22 | — | — | — | 2.52 | 0.57 | 1.15 | 0.58 | 0.09 |
| No. 4 | Bal. | 20.13 | 3.94 | — | 9.68 | — | — | — | 2.38 | 0.43 | 0.95 | 0.47 | 0.09 |
| No. 5 | Bal. | 19.61 | 5.18 | — | — | 5.22 | — | — | 2.4 | 0.6 | 0.89 | 0.52 | 0.11 |
| No. 6 | Bal. | 19.85 | 3.81 | — | 4.37 | — | 6.2 | — | 2.59 | 0.52 | 0.98 | 0.4 | 0.09 |
| No. 7 | Bal. | 20.05 | — | — | 9.92 | — | — | 2.15 | 2.55 | 0.48 | 1.08 | 0.51 | 0.1 |
| No. 8 | Bal. | 19.44 | 8.59 | — | — | — | — | — | 3.12 | 1.06 | 2.95 | 0.63 | 0.1 |
| No. 9 | Bal. | 19.31 | — | — | 15.63 | — | — | — | 2.92 | 0.98 | 3.12 | 0.55 | 0.09 |
| A* | Bal. | 20.38 | — | — | 14.84 | — | — | — | 10.32 | 0.92 | 0.92 | 0.43 | 0.1 |
| B* | Bal. | 19.74 | — | — | 15.22 | — | — | — | 20.28 | 0.95 | 0.97 | 0.55 | 0.11 |
| Stellite #6 | Bal. | 28.42 | — | — | 3.57 | — | — | — | 1.33 | — | 2.61 | 1.29 | 1.1 |

*For comparison

The alloy samples Nos. 1 to 9 according to the present invention each contained 20% of chromium and varied the respective added amounts of high-melting metals such as molybdenum, niobium, tungsten, tantalum, and rhenium. Sample No. 7 was incorporated with 2% of germanium. The amounts of silicon and carbon remained the same throughout the samples Nos. 1 to 9. The amounts of nickel, manganese, and iron were the same in the samples Nos. 1 to 7 and slightly larger in the samples Nos. 8 and 9. The total amount of nickel, manganese, and iron was about 4% in the samples Nos. 1 to 7 and about 7% in the samples Nos. 8 and 9. On the other hand, the comparative samples A and B have almost the same chemical composition as the existing cobalt-based heat-resistant alloy. They differ from the alloys according to the present invention in that the amount of nickel is high. The total amount of nickel, manganese, and iron was about 12% in alloy A for comparison and about 22% in alloy B for comparison. Stellite #6 is the most popular grade among wear-resistant stellite alloys.

Each of the samples was prepared from an ingot having the specified chemical composition by forging (several times) and solution treatment at 1200° C. for 2 hours. A specimen of stellite #6 was cut out of an overlay on a stainless steel sheet.

Observations on fine structure revealed that all the samples (Nos. 1 to 9) have the additional elements almost uniformly dissolved in the cobalt matrix, except for a small amount of chromium carbide precipitation (a few micrometers in diameter). Samples Nos. 2 and 5, which were incorporated with niobium and tantalum, respectively, were found to contain carbide of niobium or tantalum. Each of the crystal grain diameters of the developed alloys was found to range from 50 to 200 μm on average. Comparative samples A and B have almost the same fine structure as the samples according to the present invention, with carbide in sample B being coarser (ten-odd micrometers). The fine structure of stellite #6 was found to contain a large number of chromium carbide particles which are densely distributed.

Specimens were taken from the alloy samples thus prepared. They were tested for wear resistance at high temperatures. Two kinds of specimens were used, one being in the form of sheet and the other being in the form of pin with a knife-edge tip.

Wear resistance test was carried out in the following way. The specimen in sheet form (referred to as mobile specimen hereinafter) and the specimen in pin form (referred to as stationary specimen hereinafter) are arranged such that the flat part of the former rests on the vertically held edge of the latter. Then the mobile specimen is moved back and force against the stationary specimen under a load vertically applied to the back side of the mobile specimen. The stationary specimen is sharpened so that the edge tip has a radius of curvature of 0.2 mm. The load applied to the mobile specimen was 5 kg, and the mobile specimen was moved with amplitude of 0.5 mm and at a frequency of 120 Hz. The two specimens for the test were prepared from the same alloy. The test was run in the atmosphere for 5 hours at room temperature, 500° C., and 700° C. After the test, the stationary specimen was measured for loss due to wear.

The results of the wear resistance test carried out on the alloy samples 1 to 7 and the comparative samples A and B are shown in Table 2.

TABLE 2

Results of wear resistance test (between identical alloys)

(unit: μm)

| Sample | Room temperature | 500° C. | 700° C. |
|---|---|---|---|
| No. 1 | 506 | 28 | 18 |
| No. 2 | 472 | 22 | 27 |
| No. 3 | 531 | 21 | 9 |
| No. 4 | 520 | 17 | 21 |
| No. 5 | 491 | 27 | 22 |
| No. 6 | 503 | 19 | 12 |
| No. 7 | 465 | 34 | 29 |
| No. 8 | 478 | 42 | 36 |
| No. 9 | 481 | 44 | 32 |
| A (for comparison) | 493 | 59 | 57 |
| B (for comparison) | 436 | 73 | 164 |
| Stellite #6 | 57 | 76 | 14 |

Test Conditions:

Amplitude: 0.5 mm

Frequency: 120 Hz

Load: 5 kgf

It is noted that the samples according to the present invention and comparative samples A and B suffered considerable wear (400 μm to 500 μm or more) at room temperature, whereas the amount of wear of stellite #6 at room temperature is very small (57 μm). The fact that comparative sample B suffered wear least among the samples tested (except for stellite #6) suggests that the alloys according to the present invention are not superior in wear resistance at room temperature. However, the result of wear resistance test at 500° C. indicate that all the samples tested (except stellite #6) greatly decreased in the amount of wear. A probable reason for this is that heating at a high temperature in the atmosphere forms oxide scale on the alloy surface and this oxide scale lowers the coefficient of friction of the sliding surface. Depth of wear is 50 μm or more in comparative alloys A and B, whereas it is 30 μm or less and 50 μm or less in alloy samples Nos. 1 to 6 and Nos. 7 to 9, respectively, according to the present invention. In other words, the alloy samples according to the present invention are superior to comparative alloy samples in wear resistance at 500° C. The fact that depth of wear is larger in alloy samples Nos. 8 and 9 than alloy samples Nos. 1 to 7 is probably due to larger amounts of nickel, manganese, and iron. Nevertheless, the values of depth of wear given above apparently indicate the superiority of alloy samples Nos. 8 and 9 in wear resistance over comparative alloy samples A and B. A probable reason why stellite #6 slightly increases in wear at 500° C. is that it contains a large number of hard carbide particles.

The alloys (Nos. 1 to 9) according to the present invention change only a little in the amount of wear when the test temperature is raised from 500° C. to 700° C. Comparative sample A has almost the same amount of wear at 500° C. and 700° C. (50 μm); however, comparative sample B (with a high nickel content) increases in the amount of wear in going from 500° C. to 700° C. (160 μm or more). This result apparently suggests that nickel greatly affects the wear resistance of the cobalt-based alloy at high temperatures. Stellite #6 greatly decreases in the amount of wear (down to 14 μm) at 700° C. A similar trend is observed in samples Nos. 1, 3, and 6, and this indicates that they are comparable with stellite #6 in wear resistance. It is concluded from the foregoing that the alloys according to the present invention are poor in wear resistance at room temperature but significantly improve in wear resistance as temperature rises. At 500° C. or 700° C., they are equal or comparable to stellite #6 in wear resistance.

Figure 1B:
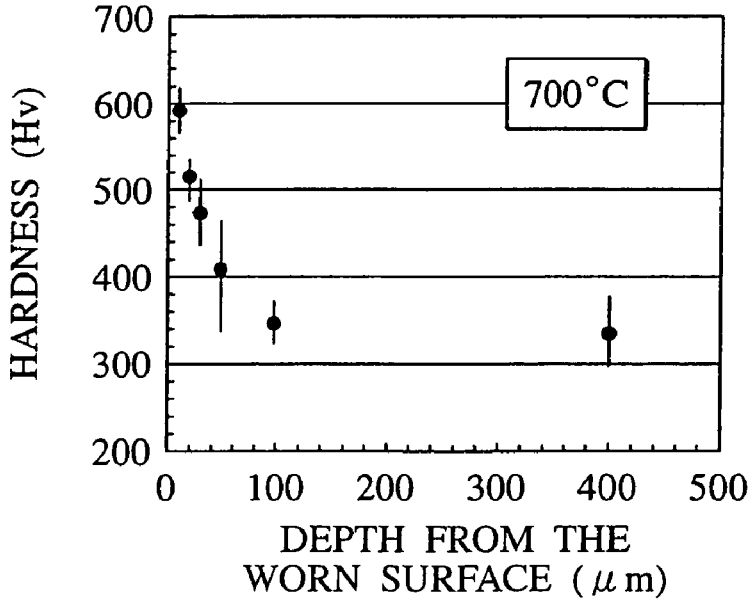

After the above-mentioned wear resistance test, the mobile specimen (in sheet form) of sample No. 1 was cut across its sliding part and the section was polished and tested for Vickers hardness. The results are graphically shown in FIGS. 1A and 1B, with the ordinate representing the hardness and the abscissa representing the depth from the sliding surface. (Point 0 on the abscissa denotes the sliding surface.) It is noted that as compared with samples tested at room temperature (FIG. 1A), samples tested at 700° C. are much higher in hardness in the neighborhood (50 μm or less) of the surface as shown in FIG. 1B. It is particularly noted that hardness steeply increases as the depth decreases. A probable reason for this is that a large amount of strain accumulates, resulting in work hardening, near the surface when the specimen undergoes wear at high temperatures.

Figure 2:
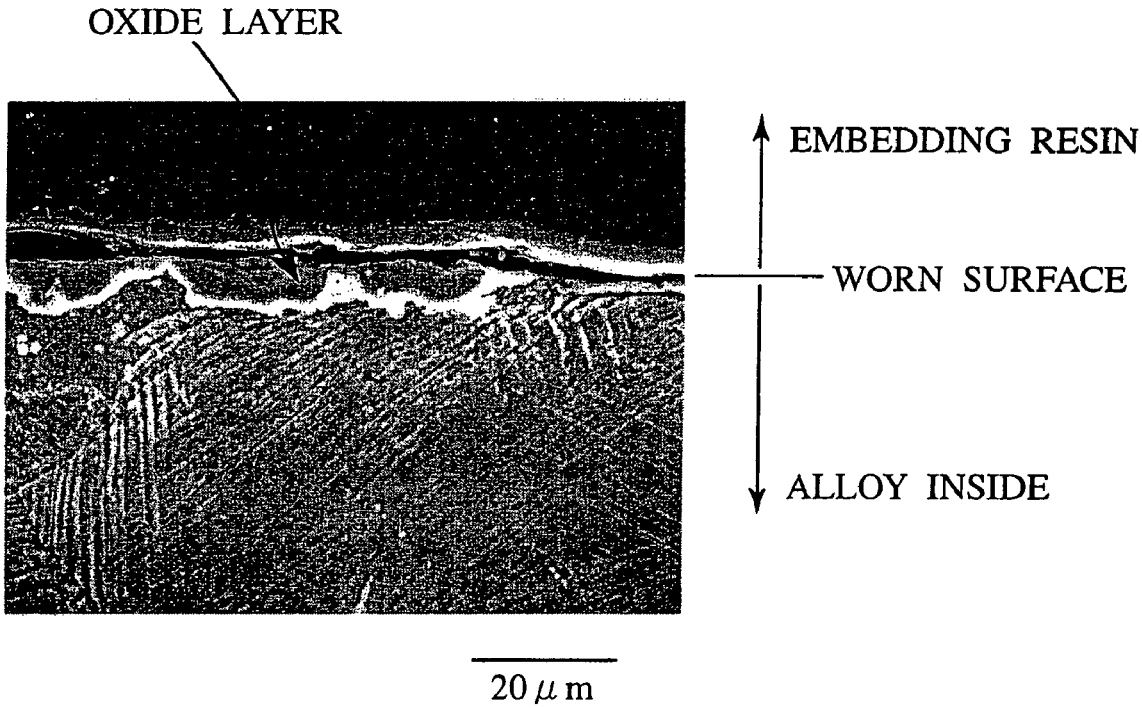
FIG. 2 is a photograph showing the sectional fine structure of the alloy of the present invention (sample No. 1) which was taken after wear resistance test at 700° C.

After the above-mentioned wear resistance test at 700° C., sample No. 1 was examined for fine structure in the vicinity of the worn surface. The result is shown in FIG. 2. It is noted that there exists an oxide layer (presumably due to friction at high temperatures) in the worn surface and there are many slip lines (due to deformation) in the underlayer. The result of hardness measurements revealed that hardness greatly increases in the region where such slip lines are dense. Presumably, the presence of many slip lines suggests that dislocations in the deformed metal structure accumulate (without recovery) near the surface, giving rise to work hardening.

It is the chemical composition that prevents dislocation from recovery, thereby promoting work hardening. If the amount of the elements that promote work hardening is increased while the amount of the elements that impede work hardening is decreased, then the resulting alloy would exhibit good wear resistance at high temperatures. It was found by the present inventors that such work hardening takes place over a broad temperature range from 400° C. to 800° C. It is necessary to account for the reason why the alloys according to the present invention do not give rise to work hardening at room temperature. Nevertheless, the alloys according to the present invention are apparently useful as members for gas turbines because they exhibit good wear resistance at high temperatures.

The alloy samples Nos. 1 to 9 in this example were easily formed into a thin sheet (2 mm thick) without cracking and other damages by repeated pressing (or rolling) and heat treatment at room temperature or high temperatures. After heat treatment, the thin sheet was easily formed by cold pressing with molds. As mentioned above, this example demonstrated that the alloys according to the present invention are superior not only in wear resistance at high temperatures but also in workability and formability.

EXAMPLE 2

Figure 3:
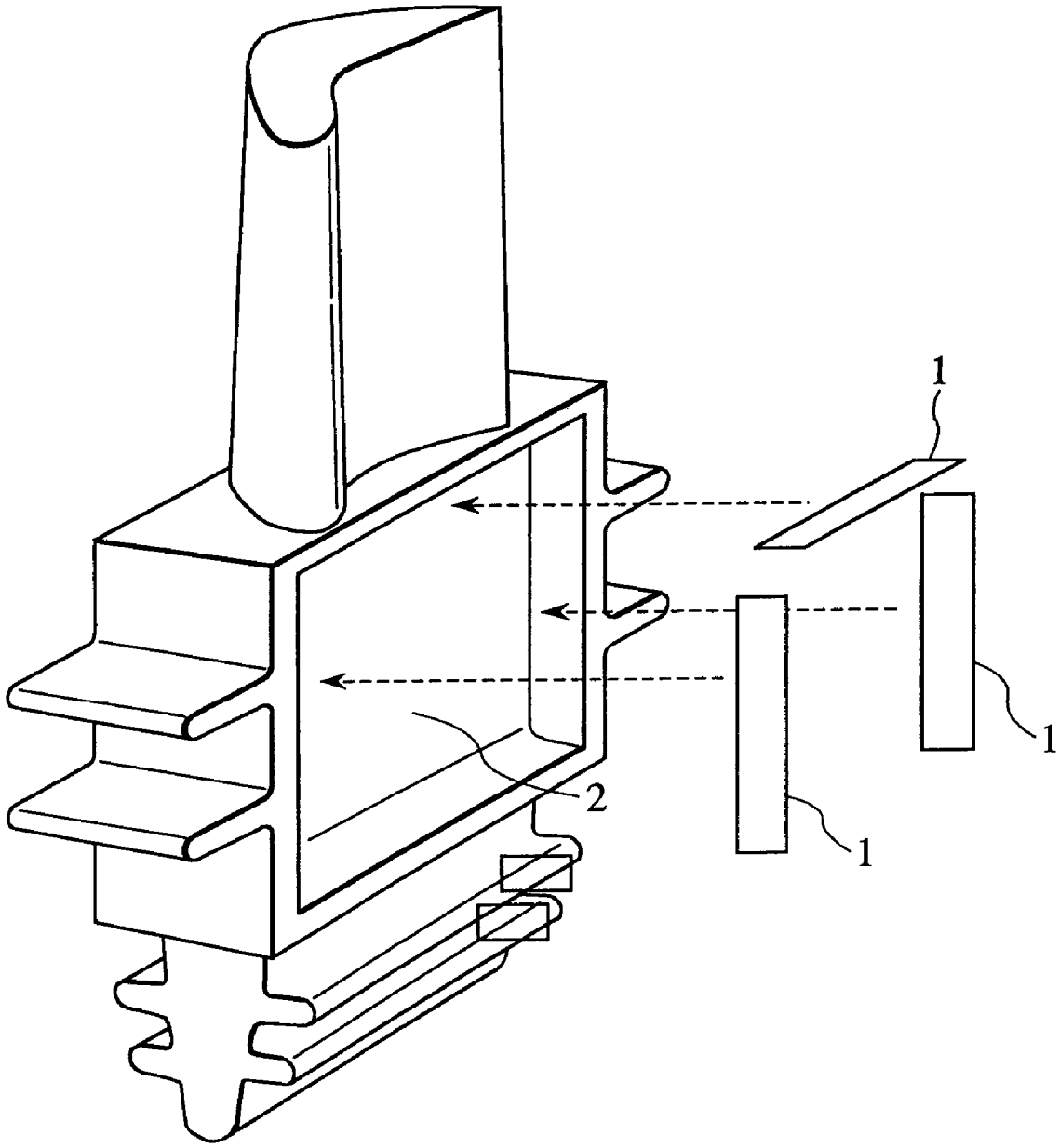
FIG. 3 is a schematic diagram showing how seal pins are attached to a turbine blade.

There is an instance where the shank of a turbine blade is provided with plate members called seal pins so as to protect the blade from vibration during revolution and to seal cooling air. FIG. 3 illustrates how to attach seal pins to the blade. The three seal pins 1 attached to the inside of the blade shank 2 stabilize the blade. They are subject to wear while the turbine is running.

Seal pins 1 were produced from the cobalt-based alloy (sample No. 1 in Table 1), and they were attached to actual turbine blades for combustion test. The production of seal pins involved forging, solution treatment, and pressing at room temperature. For comparison, seal pins were also produced by forging from an existing nickel-based alloy or cobalt-based alloy. The seal pins produced from the cobalt-based alloy according to the present invention showed no sign of wear and damage after combustion test, whereas some of the comparative seal pins showed sign of wear at their edges.

EXAMPLE 3

Figure 4A:
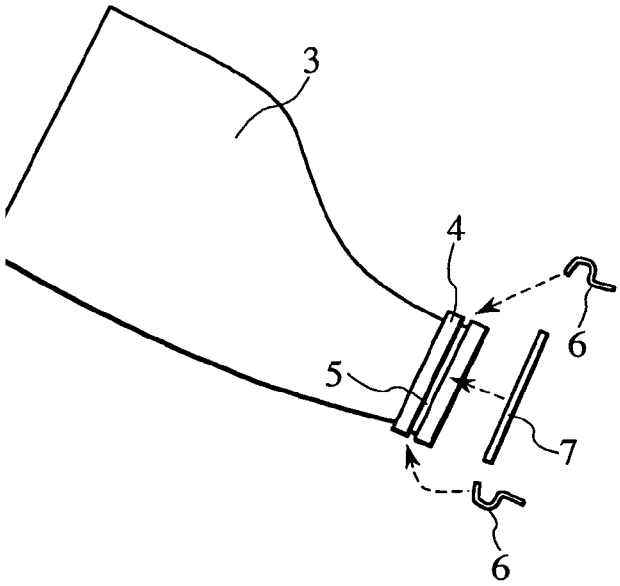
FIG. 4 (left and right sides) are diagrams showing a transition piece and how sealing plates are attached to the frame (FIG. 4 (left side) is a side elevation, and FIG. 4 (right side) is a front elevation as viewed from the exit)
Figure 4B:
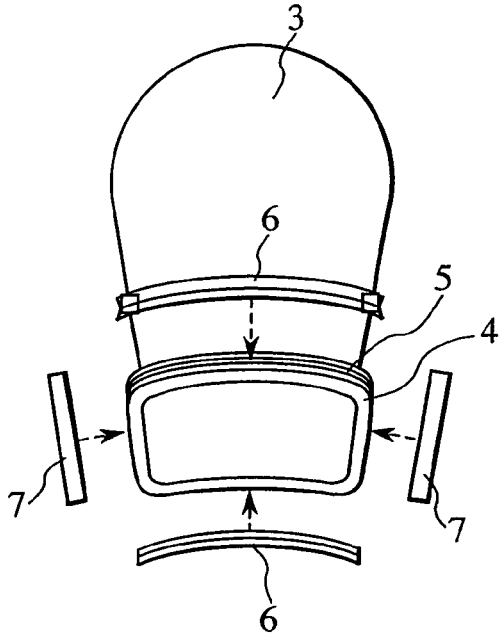
Figure 5:
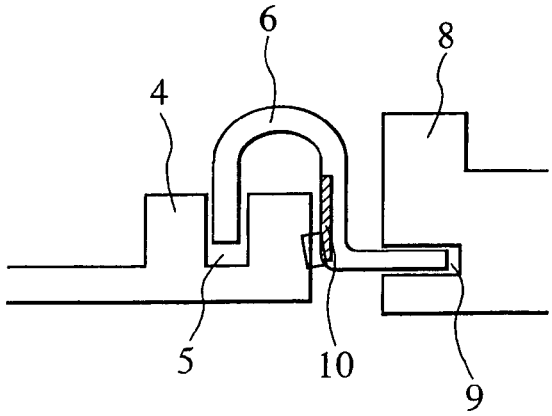
FIG. 5 is a sectional view showing how the sealing plate is attached to the frame of the transition piece.

A gas turbine has a cylindrical member called transition piece which introduces high-temperature gas from the combustor liner to the turbine. This member is constructed as shown in FIGS. 4A and 4B. The transition piece proper 3 has a round gas entrance opening (which fits to the combustor liner) and a square gas exit opening. The square opening has a square frame 4, and the square frame 4 has grooves into which sealing plates 6 and 7 are fitted so as to seal high-temperature gas. The sealing plates in contact with the frame are subject to wear due to vibration. The sealing plates 7 to fit adjacent frames to each other are flat, but the sealing plates 6 to fit the frame to the initial stage stationary blades have their edges bent by pressing. (The bent part of the sealing plate catches the groove 5 of the frame.) FIG. 5 is a sectional view showing how the sealing plate 6 is attached to the frame 4 and the initial stage stationary blade 8. Wear occurs mainly on the surface of the sealing plate 7 and the inside 10 of the bent part of the sealing plate 6, as shown in FIG. 5.

The sealing plates 6 and 7 were produced from the cobalt-based alloy (sample No. 3 in Table 1) by forging, solution treatment, and cold pressing in the same way as in Example 2. The bent part of the sealing plate 6 was formed also by cold pressing. The result of combustion test with an actual gas turbine showed that the sealing plates produced from the existing cobalt-based alloy suffered wear on the surface of the plate 7 and on the inside 10 of the bent part, whereas the sealing plates produced from the cobalt-based alloy according to the present invention suffered wear only slightly (⅓ or less). Thus this example demonstrated that the cobalt-based alloy of the present invention is very effective in reduction of wear.

The cobalt-based alloy according to the present invention exhibits good wear resistance at high temperatures (comparable to that of stellite #6 as a typical conventional wear resistant material) owing to the work hardening properties of its matrix even though it does not contain a large amount of hard particles (such as carbides) in its structure. In addition to good wear resistance, it also has good workability and formability into high-temperature members for use in a gas turbine. Owing to reduced wear, such members contribute to the reduction of maintenance cost of gas turbines and the improvement of operating efficiencies of gas turbines.

While the invention has been described in its preferred embodiments, it is to be understood that the words which have been used are words of description rather than limitation and that changes within the purview of the appended claims may be made without departing from the true scope and spirit of the invention in its broader aspects.

What is claimed is:

1. A high-temperature member of a gas turbine, comprising:

a member which is a sliding part of a gas turbine and which is subjected to a temperature of about 400° C. to about 800° C., said member which is a sliding part being plastic worked at high temperature or room temperature by forging, rolling or pressing from a cobalt-based alloy which comprises 15-35 wt % of chromium, 0.02-1.5 wt % of silicon, 0.5-4.0 wt % of nickel and 0.01-0.2 wt % of carbon, at least one species selected from five refractory metals including 1-12 wt % of molybdenum, 0.3-8 wt % of niobium, 1-20 wt % of tungsten, 1-10 wt % of tantalum, 1-10 wt % of rhenium, 0.43-4 wt % of manganese, 0.5-4 wt % of iron, and said nickel, manganese, and iron such that their total amount is in the range of 1.43-9 wt %, with the remainder being cobalt and inevitable impurities, with the total amount of said five refractory metals not less than 8.59 wt % and not exceeding 10% (by atomic ratio) of the entirety of the alloy excluding carbon wherein said member which is a sliding part is one of a seal pin, which is provided on the shank of a turbine blade to protect the turbine blade from vibration and to seal the cooling air; and a sealing plate, which is provided on a transition piece which introduces high-temperature gas from the combustor liner to the turbine to seal said high-temperature gas.

2. A high-temperature member of a gas turbine, comprising:

a member which is a sliding part of a gas turbine and which is subjected to a temperature of about 400° C. to about 800° C., said member being plastic worked at high temperature or room temperature by forging, rolling or pressing from a cobalt-based alloy which comprises 15-35 wt % of chromium, 0.02-1.5 wt % of silicon, 0.5-4.0 wt % of nickel and 0.01-0.2 wt % of carbon, at least one species selected from five refractory metals including 1-12 wt % of molybdenum, 0.3-8 wt % of niobium, 1-20 wt % of tungsten, 1-10 wt % of tantalum, 1-10 wt % of rhenium, 0.43-4 wt % of manganese, 0.5-4 wt % of iron, and said nickel, manganese, and iron such that their total amount is in the range of 1.43-9 wt %, with the remainder being cobalt and inevitable impurities, with the total amount of said five refractory metals not less than 8.59 wt % and not exceeding 10% (by atomic ratio) of the entirety of the alloy excluding carbon, and wherein said alloy further comprises 0.1-4 wt % of germanium.

3. A high-temperature member for use in a gas turbine, which is formed from a cobalt-based alloy defined according to claim 1 into a sheet applicable to a gas turbine by rolling or pressing at a high temperature or room temperature.

4. A gas turbine which is provided with the member defined in claim 3.

5. A high-temperature member for use in a gas turbine, said member being formed from a cobalt-based alloy defined in claim 1, wherein said alloy further comprises 0.1-4 wt % of germanium.

* * * * *